US005193320A

United States Patent [19]

Coccagna

[11] Patent Number: 5,193,320

[45] Date of Patent: Mar. 16, 1993

[54] MASONRY LAYING DEVICE

[76] Inventor: Daniel T. Coccagna, 417 Jonathan Pl., Philadelphia, Pa. 19115

[21] Appl. No.: 642,108

[22] Filed: Jan. 16, 1991

[51] Int. Cl.[5] ..... E04B 2/00

[52] U.S. Cl. ..... 52/442; 52/308

[58] Field of Search ..... 52/308, 307, 712, 421, 52/438, 442, 306

[56] References Cited

U.S. PATENT DOCUMENTS

| | | | |
|---|---|---|---|
| 2,124,799 | 7/1938 | Specht | 52/442 |
| 2,141,000 | 12/1938 | Hohl | 52/308 |
| 2,318,362 | 5/1943 | Boeglen | 52/308 |
| 2,929,238 | 3/1960 | Kaye | 52/442 |
| 3,420,560 | 1/1969 | Pfahning | 52/442 |
| 4,136,498 | 1/1979 | Kanigan | 52/442 |
| 4,986,048 | 1/1991 | McMarlin | 52/306 |
| 5,010,704 | 3/1991 | Thompson | 52/308 |

FOREIGN PATENT DOCUMENTS

| | | | |
|---|---|---|---|
| 495821 | 4/1976 | Australia | 52/712 |
| 22263 | of 1906 | United Kingdom | 52/712 |

*Primary Examiner*—David A. Scherbel
*Assistant Examiner*—Creighton Smith
*Attorney, Agent, or Firm*—Panitch Schwarze Jacobs & Nadel

[57] ABSTRACT

A planar leveling device includes first and second elongated, substantially rigid support members. Each member is more than about a foot in length. The first and second support members define the plane of the device and have a uniform, equal maximum heights in directions perpendicular to the plane. The members also define the maximum height of the device in those directions. Each of the two support members provides a thin edge along a planar side of the device to provide full, continuous support yet minimize the contact between the device and adjoining masonry elements. Reinforcement members may be provided on one or both sides of the support members, in the plane of the device, for greater strength and versatility. Substantially solid, unbroken sides of the support members permit the compression of mortar into the joint formed by the device between parallel adjoining courses of masonry elements in a wall.

44 Claims, 3 Drawing Sheets

MASONRY LAYING DEVICE

FIELD OF THE INVENTION

The invention relates to aids for use in laying masonry (e.g. block or brick) and, in particular, to devices inserted between courses of laid masonry elements to level the courses and reinforce the wall.

BACKGROUND OF THE INVENTION

A number of masonry laying aids have been proposed. While each offers certain advantages, each has significant drawbacks.

U.S. Pat. No. 4,689,931 to Hodges discloses a masonry laying device comprising a pair of sawtooth-shaped arm members held in parallel by a bridge member. The devices are laid between courses of masonry elements with the upper and lower parts of the sawtooths contacting the elements of the upper and lower courses, respectively. The sawtooth permits the devices to be overlaid at different angles and in different, intersecting planes. However, the sawtooth provides openings through which the mortar can pass when being struck by the mason, preventing good compression of the mortar for strengthening the resulting mortar joint.

U.S. Pat. No. 4,136,498 to Kanigan describes another device including a lattice or web of vertical walls having a height equal to a desired height between courses of masonry elements and additionally provided with upper and lower projecting conical members supported on the webs. The conical members are intended to be received in the vertical apertures provided in certain types of bricks and blocks. A major disadvantage is the inability to use the device equally with blocks or bricks lacking vertical apertures as well as those having such apertures.

U.S. Pat. No. 3,183,628 to Smith discloses a Continuous, masonry wall reinforcing device including a pair of elongated parallel members held together by one or more intermediate coupling members. Unlike the devices of the previous two patents, this device is intended to provide only reinforcement and not course leveling capability. Accordingly, it is less versatile than either of the two devices first discussed.

U.S. Pat. No. 4,095,384 to Zarriello describes the use of cardboard block spacers. Notwithstanding the partial tar coating, such spacers are subject to rot and weakening of the resulting joint. Moreover, the cardboard appears to provide less reinforcing strength than would metal or even plastic devices.

U.S. Pat. Nos. 4,277,927 to Richter, 3,501,877 to White, 3,426,497 to Mundy and 3,196,581 to Castelli all describe individual spacers for positioning between individual masonry elements. One major disadvantage of such individual elements is that they do not provide the reinforcing strength that longer, continuous elements would provide. A second disadvantage is that any leveling errors are more likely to be propagated through the wall. Longer, continuous elements tend to smooth and dampen any leveling irregularities.

SUMMARY OF THE INVENTION

In one aspect the invention is a planar leveling device comprising first and second elongated, substantially rigid support members. Each support member is about one foot or more in length. The first and second support members define the plane of the device and have uniform equal maximum heights in directions perpendicular to the plane. The device has a maximum height in directions perpendicular to the plane equal to the equal heights of the first and second support members. Each of the first and second support members is at least generally pointed along at least one side to provide only a thin edge along a planar side of the device. The device further comprises spacer means for coupling the first and second elongated members together in spaced, side-by-side relation.

In another aspect the invention is the planar leveling device comprising first and second elongated, substantially rigid support members. Each support member is about one foot or more in length. The first and second support members define the plane of the device and have uniform equal maximum heights in directions perpendicular to the plane of the device. The device has a maximum height in a direction perpendicular to the plane equal to the equal heights of the first and second support members. The device further comprises spacer means for coupling the first and second elongated members together in spaced, side-by-side relation. The device further comprises an elongated reinforcing member extending generally in the plane of the device to one side of the first and second support members, spaced from the support members. The reinforcing member has a height in directions perpendicular to the plane less than the maximum height and is coupled with at least one of the first and second support members and the spacer means.

In another aspect, the invention is a wall construction comprising a first course of masonry elements, a second course of masonry elements overlying the first course of elements, and a planar leveling device between the first and second courses. The device comprises first and second elongated, substantially rigid support members and spacer means for coupling the first and second support members together in spaced, side-by-side relation. Each support member is about one foot or more in length and spans at least pairs of adjoining elements in each of first and second courses. The first and second support members define the plane of the device and have uniform equal maximum heights in directions perpendicular to the plane. The device has a maximum height in directions perpendicular to the plane equal to the equal heights of the first and second support members. Each of the first and second support members is pointed along at least one side to provide only a thin edge along a planar side of the device. Each of the edges contacts the elements of one of the first and second courses. The device directly contacts elements of both of the first and second courses to space the courses apart a distance equal to the maximum height of the device.

In another aspect, the invention is a wall construction comprising a first course of masonry elements; a second course of masonry elements overlying the first course; and a planar leveling device between the first and second courses. The device comprises first and second elongated, substantially rigid support members, spacer means for coupling the first and second support members together in spaced, side-by-side relation, and an elongated reinforcing member. Each support member is about one foot or more in length and spans at least pairs of adjoining elements in each of the first and second courses. The first and second support members define the plane of the device and have uniform equal maximum heights in directions perpendicular to the plane.

The device has a maximum height in directions perpendicular to the plane which is equal to the equal heights of the first and second support members. The reinforcing member extends generally in the plane of the device to one side of the first and second support members, spaced from the support members. The reinforcing member has a height in directions perpendicular to the plane less than the maximum height and is coupled with at least one of the first and second support members and the spacer means. The construction further comprises a bonding joint extending between the first and second courses and against an outer side of one of the first and second support members for binding the first and second courses together on upper and lower sides of the device, the reinforcing member being embedded in the joint.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention there shown in the drawings embodiments which are presently preferred. It should be understood, however, the invention is not limited to the precise arrangements and instrumentalities shown. In the drawings.

DETAILED DESCRIPTION OF PREFERRED EMBODIMENTS

Figures 1, 7:
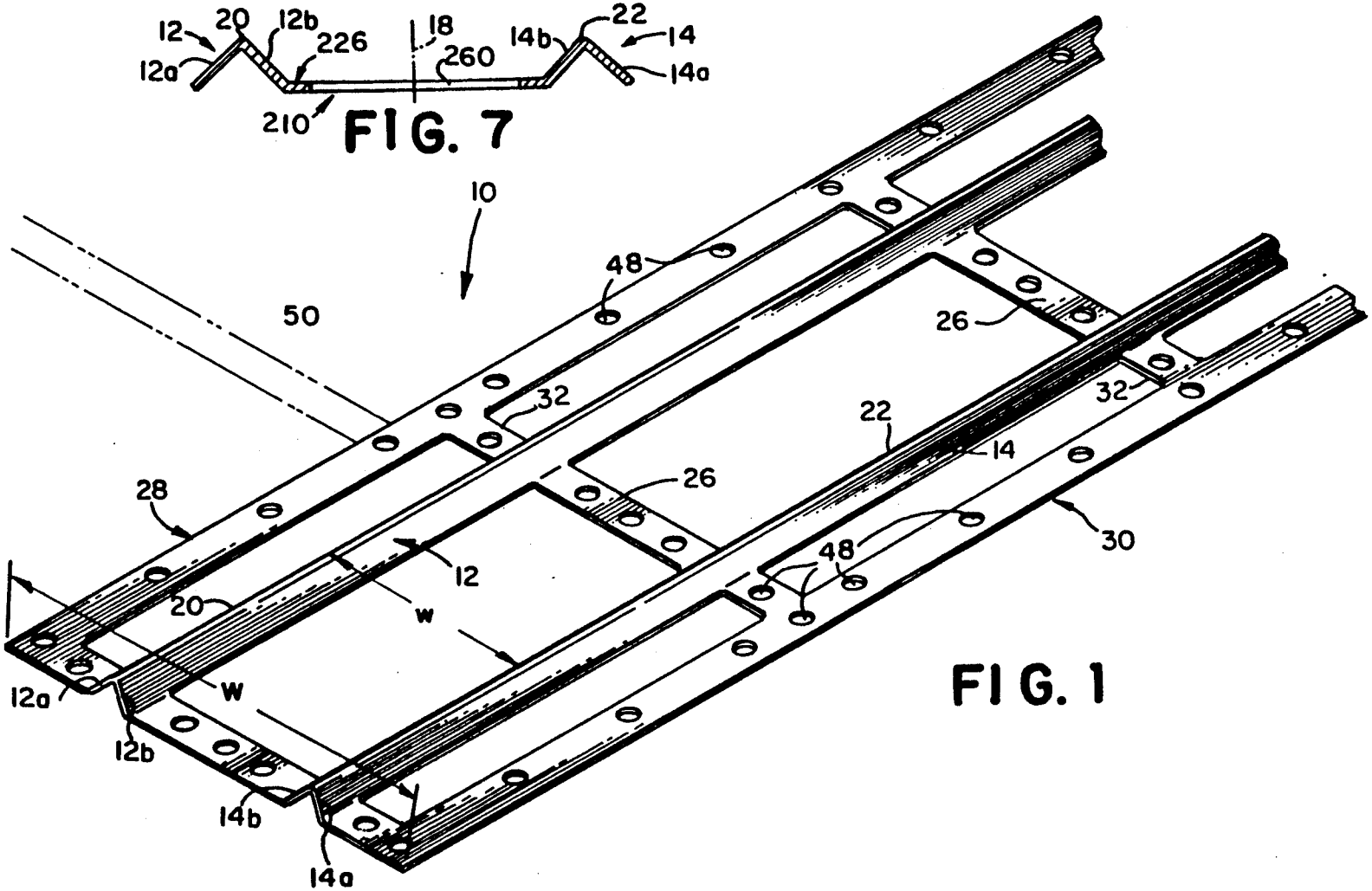
FIG. 1 is a diagrammatic isometric view of a first embodiment leveling device of the invention.
FIG. 7 is a diagrammatic cross-sectional view of a third embodiment leveling device of the present invention.
Figure 2:
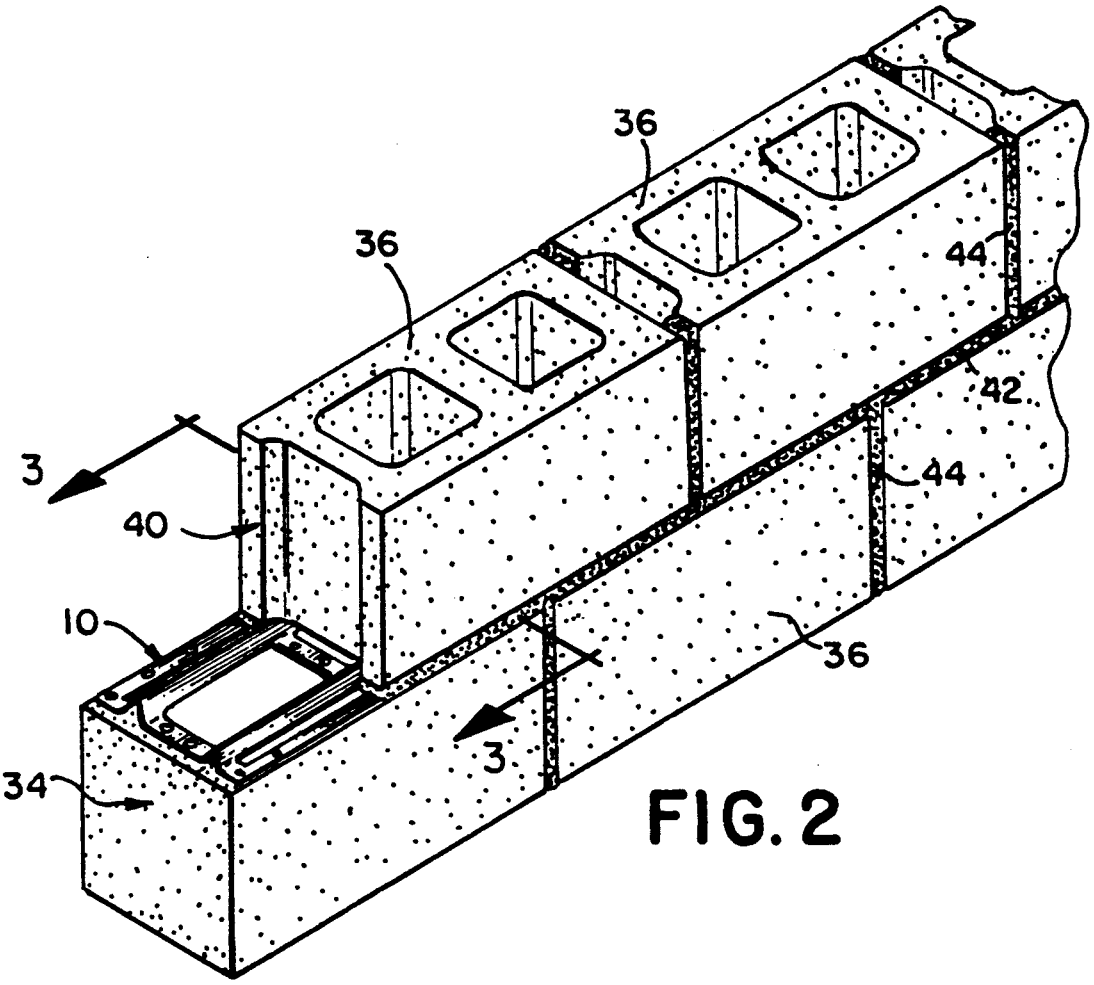
FIG. 2 is a diagrammatic isometric view of the device of FIG. 1, incorporated into a wall of masonry elements.
Figure 3:
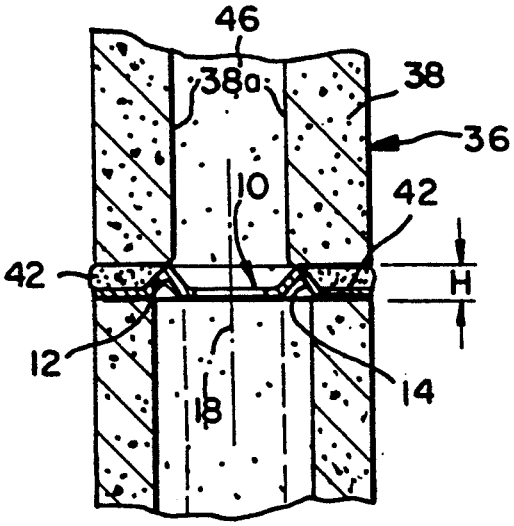
FIG. 3 is a transverse section of a portion of the wall construction taken along the lines 3—3 in FIG. 2.

A first embodiment planar leveling device, indicated generally at 10 in FIGS. 1 through 3, is provided for laying courses of masonry elements, preferably uniformly shaped elements such as block or brick, in wall construction. The device 10 comprises first and second, elongated support members 12 and 14, respectively. Each of the support members 12 and 14 is substantially rigid, meaning that the members 12 and 14 do not collapse to any significant extent when used in the manner described to space and support courses of masonry elements. Each of the support members 12 and 14 is about one foot or more and, preferably, more than one foot in length so as to at least partially span adjoining pairs of longitudinally laid elements.

Referring to FIG. 3, the first and second support members 12 and 14 define the plane of the device 10, which is horizontal in that figure. The members 12 and 14 have uniform, equal maximum heights "H" in directions perpendicular to the plane of the device, i.e. in vertical directions in FIG. 3 perpendicular to the horizontal plane of the device 10 in that figure. The maximum height of the device 10 in directions perpendicular to the plane of that device is equal to "H", the equal heights of the first and second support members 12 and 14. Each of the first and second support members 12, 14 is generally of an inverted "V" shape in the figures. The "V" of each member 12, 14 is generally pointed by being sharply radiused or creased to provide a generally thin edge 20 and 22, respectively, in FIG. 1, at the apex of the "V". Each edge 20, 22 is located on one planar side of the device 10, the upper planar side in all of the figures. As is best seen in FIG. 3, each of the edges 20, 22 is parallel to the plane of the device 10 which is horizontal in that figure. Spacer means, indicated generally at 26 in FIG. 1, are provided for coupling the elongated members 12 and 14 together in a spaced, side-by-side preferably parallel relation. Preferably, a pair of elongated reinforcing members 28 and 30 is also provided extending generally in the plane of the device. Each reinforcing member 28 and 30 extends to one side of the first and second support members 12 and 14, respectively, spaced from those support members. Bridge members 32 uniformly spaced along the length of the device 10, fixedly couple the reinforcing members 28 and 30 with the nearest support member 12 and 14, respectively.

Figure 4:
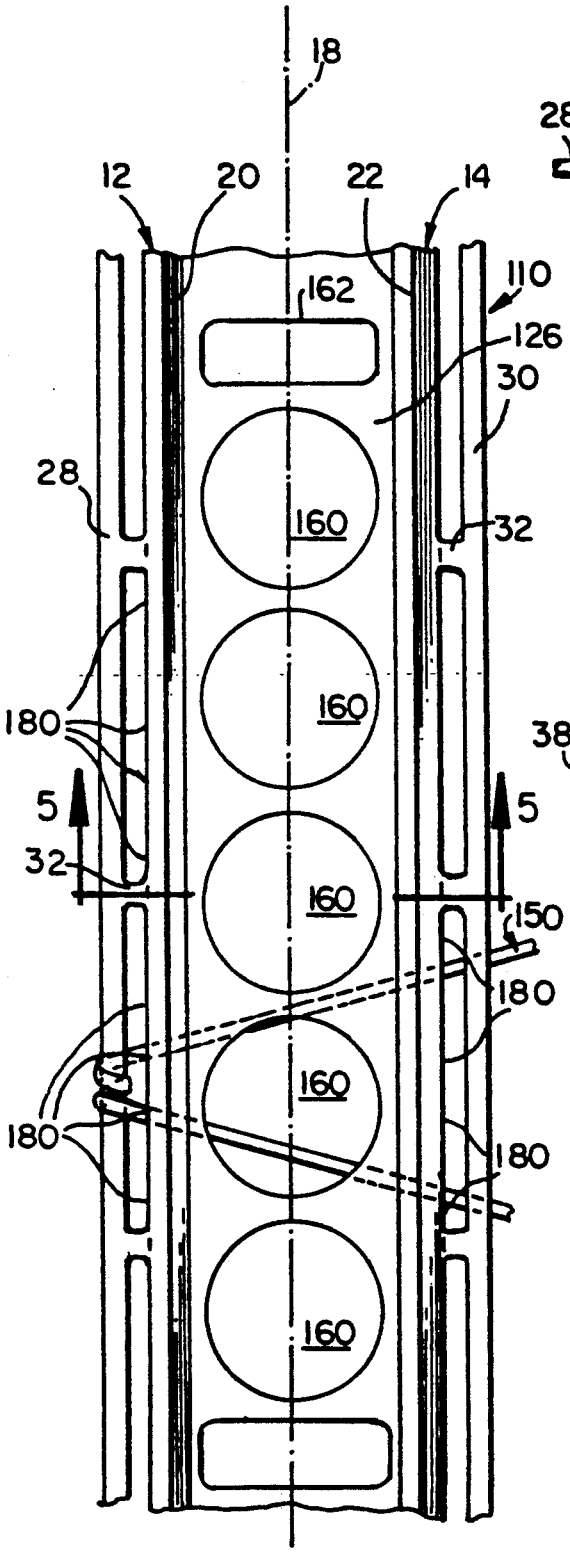
FIG. 4 is a diagrammatic plan view of a second embodiment leveling device of the present invention.
Figure 5:
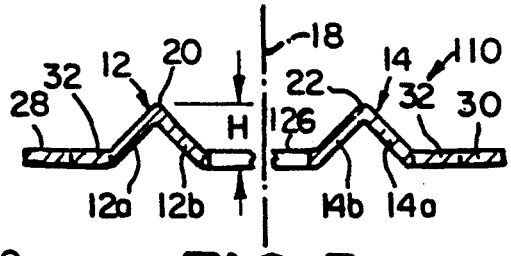
FIG. 5 is an end view of the device taken along lines 5—5 of FIG. 4.
Figure 6:
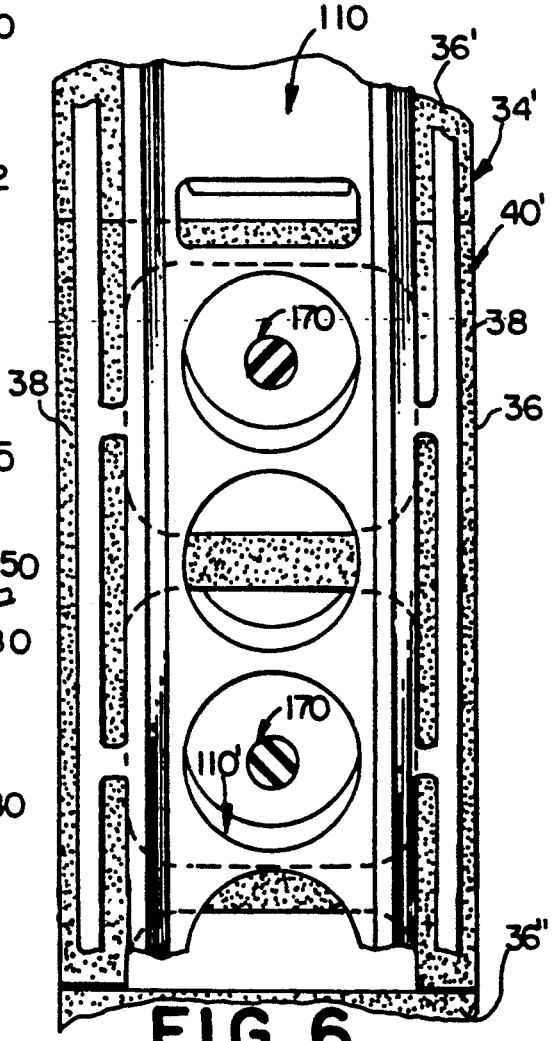
FIG. 6 is a diagrammatic, plan section view of a wall incorporating the second embodiment device of FIGS. 4 and 5.

A second embodiment planar leveling device, indicated generally at 110 in FIGS. 4 through 6, is also provided for laying courses of masonry elements 36, preferably uniformly shaped elements such as block or brick, in wall construction. Referring to FIG. 4, the device 110 comprises first and second, elongated support members 12 and 14, respectively, identical to the support members 12 and 14 of the embodiment of FIGS. 1 through 3. Again, each of the support members 12 and 14 is substantially rigid, about one foot or more, preferably more, in length so as to at least partially span adjoining pairs of longitudinally laid elements, of equal heights "H", and, preferably, generally of an inverted "V" shape. Each member 12 and 14 preferably provides a continuous parallel thin edge 20 and 22, respectively, at the apex of the "V". Each of the edges 20 and 22 is located on one planar side of the device 110, the upper planar side in all of the figures. Each edge 20, 22 is parallel to the plane of the device 110.

The substantial difference between the devices 10 and 110 is with respect to the spacer means. The spacer means of device 110 is indicated generally at 126. The spacer means couples the elongated support members 12 and 14 together in spaced, side-by-side, preferably parallel relation. In place of the large rectangular openings provided by the ladder-type cross members forming the spacer means 26 of the device 10, device 110 includes a spacer means 126 provided by a web extending substantially continuously between inner facing sides of the support members 12 and 14. Preferably, a plurality of openings 160 of a first size and shape, preferably circular about two-and-one-half inches in diameter, are provided. If desired, individual openings provided, of another size and shape, can be one of which being indicated at 162. Each opening 162 is preferably generally rectangular with a long dimension (major axis) of about two-and-one-half inches and a short dimension (minor axis) of about one inch. The web of the spacer means 126 provides additional reinforcement over the individual spacer members 26 of the device 10, adding to the stiffness of the device 110. Preferably, openings 160 are uniformly spaced from one another. Openings 162, when provided, are also preferably uniformly spaced from one another separated by one or more openings 160. Preferably, the spacing of openings 162 are related to a dimension of the block or brick with which it is used. Thus, for conventional cinder block laid longitudinally, the openings 162 may be spaced sixteen inches on center, corresponding to the longitudinal dimension of each block. In this way, the device 110 can also be used to indicate proper spacing between the elements 34 along each course as well as proper height spacing between courses.

A third embodiment leveling device, indicated generally at 210 in FIG. 7, is also provided for laying courses of masonry elements 36, preferably uniformly shaped elements such as block or brick, in wall construction. Referring to FIG. 7, the device 210 is basically a simplified version of device 10 and consists essentially of only first and second, elongated support members 12 and 14, respectively, again identical to the support members 12 and 14 of the embodiments of FIGS. 1 through 6, and spacer means 226 for coupling the support members 12 and 14 together in spaced, side-by-side, preferably parallel relation. Again, each of the support members 12 and 14 is substantially rigid, about one foot or more, preferably more, in length so as to at least partially span adjoining pairs of longitudinally linked elements, of equal heights "H", and, preferably, generally of an inverted "V" shape. Each member 12 and 14 again preferably provides a continuous thin edge 20, 22, respectively, at the apex of the "V". Each of the edges 20 and 22 is located on one planar side of the device 110, the upper planar side in the figure. Again, each edge 20, 22 is preferably parallel to the plane of the device. The spacer means 226 can be formed by part of a one-piece continuous web used to form the entire device 210 and extend generally parallel to the plane of the device between the lowermost edges of each of the adjoining sides **12*b* and 14*b* of the support members 12 and 14, respectively. Again, individual openings 260, preferably rectangular like the embodiment of FIGS. 1–3, or of another or other shapes, including circular, like the embodiment of FIGS. 4 through 6, are provided to receive transversely extended reinforcements. The device 210 differs from the device 10 in FIGS. 1 through 3 substantially by the elimination of the reinforcement members 28 and 30 and bridge members 32 connecting those reinforcement members with the adjoining support members 20 and 22**, respectively.

For ease of manufacture and use, the devices 10, 110 and 210 are preferably symmetric with respect to a central longitudinal plane, which is seen on end in FIGS. 3, 5 and 7 as line 18 and which stretches along the length of each of the devices 10 and 110 perpendicularly to the plane of each of the devices 10 and 110 in FIGS. 3, 5 and 7.

Preferably, each of the devices 10, 110 and 210 is formed as a one-piece unit by conventional means, preferably such as cutting or stamping from continuous strips of metal, such as, for example, sheet carbon steel about 25 mils to about 60 mils in thickness. The devices 10 and/or 210 could also be made, for example, by spot welding separate metal components. Similarly, each device 10, 110 and 210 could be a plastic molding or a plastic fabrication formed from bonding together with suitable adhesives, individual plastic parts, or even a hybrid construction of different materials.

Various features and benefits of each of the devices 10, 110 and 210 will now be explained in connection with the following description of the use of the device 10 in wall construction with successive courses of overlaid masonry elements. Devices 110 and 210 are used in substantially the same manner. As is best seen in FIG. 2, the device 10 is typically used by laying a first, horizontal course of individual masonry elements 36, preferably of uniform dimensions. The first course is itself identified generally at 34. The device 10 is laid atop the first course 34 with its bottom planar side contacting that course. A second course 40 of masonry elements 36 is laid atop the device 10. The device 10 supports the overlying second course of elements 36 and spaces the elements of the second course 40 a uniform height "H" above the elements 36 of the first course 34. The masonry elements 36 are bonded together by horizontal and vertical joints 42 and 44, respectively, suggestedly with an appropriate mortar.

Preferably, the openings 160 (and 162, if desired) are provided in device 110 in such numbers, sizes and shapes as to permit reinforcement means such as reinforcing bars 170, to be passed down through the successive courses of masonry elements 36 and through the successive underlying devices 110. This is indicated diagrammatically in FIG. 6 where a first device 110 is laid upon a first masonry element 36 of an uppermost course of elements 40' in a wall under construction. Underlying the first element 36 is another one of the leveling devices indicated at 110' partially seen through openings 160 and 162 in the top device 110. Underlying device 110' is a lower, continuous course 34' of masonry elements, the visible portions of two adjoining elements of the course 34' being indicated at 36' and 36''. The areas of the openings 160 are preferably several times larger than the cross-sectional areas of the reinforcement means 170 passed through the openings 160, but still significantly smaller less than the open area(s) which extend through the hollow block or brick elements 36 laid with the devices 110 and which are indicated in phantom at 44, and the open areas provided by support members 12 and 14 and spacer means 26 in device 10. Upper ends of the reinforcement means 170 can be attached to a lintel or embedded or inserted into or fixed to any other structure used to cap or top a wall constructed with the devices 110 and bars 170 or attached to other reinforcement means, on or adjacent to the top of such wall. The preferred two-and-one-half inch diameter major axes of the openings 160 and 162 permit one die to be used on devices like device 110 having two-and-one-half inch or more spacing between the support members 12 and 14.

Preferably, the length of the device 10, 110 or 210 is as long as the wall being fabricated or, if that is not feasible, at least as can be reasonably constructed and handled. Lengths between about four and sixteen feet are believed practical for most applications and preferred for convenience and performance (reinforcement and leveling). Though not depicted, connectors such as mating tubes and pins, for example, might be provided at the ends of any of the devices 10, 110 or 210, such as by fastening to any device 10, 110 or 210 within the hollow of the support members 12 and 14, for joining plural devices 10, 110 and/or 210 together end-to-end to form a longer yet planar composite device for longer wall lengths.

The uniform height "H" of each device 10, 110 and 210 and of the support members 12 and 14 permits a substantially uniform spacing of equal height "H" between each underlying/overlaid course 34 and 40, respectively, of the elements 36. The edges 20, 22 provide level surfaces over which a mason can run his trowel to remove excess mortar and assure direct contact between the edges 20 and 22 and the element(s) 36 of the overlying course. Each of the thin edges 20, 22 provides a substantially continuous support surface having only one point of contact with a masonry element anywhere along the length of the device 10, 110 or 210 to minimize leveling problems should the elements 36 have imperfections or irregularities. Each of the support members 12, 14 further effectively provides only a pair of thin edges on the opposing (lower) planar side of each of the devices 10, 110 and 210 due to the inverted "V" configuration of the members 12, 14. The edges are shown, for example, in FIG. 1 for device 10 and are provided by the ends of the support member side walls **12*a*, 12*b* and 14*a*, 14*b* exposed on the bottom planar side of device 10** in the figures.

More contact is provided on the device 110 with underlying element(s) 36 due to the essentially continuous extension of the web spacer means 126 between the support members 12 and 14. However, thin lines of contact can be provided at the ends of all support member walls **12*a*, 12*b*, 14*a*, 14*b* by creasing the device 10 or 110 where bridge members 32 join walls 12*a* and 14*a* and by creasing the device 10 or 110 where the inner walls 12*b*, 14*b* meet the spacer means 26 or 126**.

Referring to FIG. 1, some of the additional significant dimensions of the device 10 are noted. Similar dimensions would be used for devices 110 and 210. First, the overall width "W" of the device 10, 110 or 210 should be less than the width of the elements 36 between which any of the devices 10, 110 or 210 is placed so that clean joints 42 can be presented on either side of the wall. Preferably, for elements 36 having central openings 46 such as cinder blocks, which are depicted in FIGS. 2, 3 and 6, the spacer means 26 and 126 locate the first and second members 12 and 14 such that the on-center spacing "w" between edges 20, 22 respectively, is sufficiently great such that the edges 20, 22 contact the longitudinal webs 38 of the elements 36 at approximately the inner sides **38*a* of the longitudinal webs 38 of each of the masonry elements 36 (see FIGS. 3 and 6**).

The support members 12 and 14 are unbroken or, preferably, are at least substantially unbroken along their outer sides **12*a* and 14*a* over the maximum height "H" of the device 10, so as to prevent or essentially prevent penetration of the mortar forming joints 42 transversely through those members 12, 14 and into the central openings 44 of the block 36. This substantially seals the outer horizontal cavities on either side of the wall receiving the mortar or other bonding agent and permits the mason to compress the mortar or bonding agent by striking the joint material after the overlying masonry element 16 is placed upon the device 10 (or on either device 110 or 210). This capability aids in creating uniform joints 42 without bubbles, gaps or other voids, thereby increasing the strength of the joint 42. It further complements the mason's ability to set the elements directly on the device 10, 110 or 210. The mason can remove excess mortar by sliding a trowel or other tool along the edges 20 and 22 cleaning those edges for direct contact. When the mason subsequently strikes the joint 42 after placing the overlying element 36 on the devices the mortar is compressed in the joint 42 between the elements 36, the outer side 12*a* of 14*a*** of the adjoining support member and the striking tool. This is another advantage of the present device in permitting its use by lesser skilled or unskilled labor. It is not necessary for the user to develop the skill of a conventional mason in laying down mortar lines before placing an overlying element. The user simply loads on an excess amount of mortar on the device and scrapes away the excess.

FIG. 4 further depicts further possible variations upon the invention. Substantially flat, flexible strip wall ties 150 can be provided and used by wrapping each tie around either of the elongated reinforcing members 28 or 30 and passing the loose ends of each tie 150 away from the device towards an adjoining wall or support, or passing the ends beneath the support members 12, 14 and the remaining reinforcement member to a wall or support on an opposite side of the device 10 or 110 as is shown diagrammatically in FIG. 4. A single flat wall tie 150 can be used under an individual masonry element 36 having a relatively short direction parallel to the elongated direction of the device 10, for example, a small brick laid perpendicularly across either device 10 or 110 while two or more flat wall ties 150 can be used under masonry elements 36 having a long dimension in the elongated direction of the device 10 or 110 to balance the masonry element 36 and device 10 or 110. If desired, shallow notches or depressions (not depicted) also can be provided at intervals, preferably regularly spaced, along support members 12 and 14, for example at locations 180 in FIG. 4, for passing end of the planar wall tie 150 in single or even double thicknesses beneath the support member 12 or 14 without affecting the height "H". Again, it is emphasized that the notches or depressions should be shallow so as not to break the substantial continuity of the outer sides **12*a* and 14*a* (see FIGS. 3 and 5**) to permit mortar to be compressed against those sides even where wall ties are not used.

Typical dimensions for the devices 10, 110 or 210 to be used with conventional cinder block laid longitudinally would be first and second members 12, 14 approximately one-half inch wide with an on center width "w" between edges 20 and 22 of less than about five inches, preferably about between about three and one-half and four inches, and an overall width "W" of about seven inches or less. Appropriate dimensions can be determined for various other sizes and/or arrangements of elements 36.

The reinforcing members 28 and 30 and bridge members 32 are intended to be embedded in the joints 42 to firmly position the device 10 or 110 in the wall and to provide reinforcement to the joints 42. Preferably, the reinforcing members 28 and 30 and the bridge members 32 are provided with apertures 48 (FIG. 1) to permit the bonding material of the joints 42 to pass through and physically attach to those members. They further provide convenient attachment points for devices such as a conventional wall tie 50, depicted in phantom in FIG. 1, and possibly for other arrangements to couple devices 10 and/or 110 and/or 210 laid to end-to-end for longer courses.

Use of the device 10, 110 or 210 eliminates the need for lead build-ups, which conventionally have to be constructed at the ends of the courses, and for the masonry line strung between the build-ups, which provides the benchmark for laying the intermediate elements of the course running between the build-ups. This in itself would be invaluable in permitting unskilled labor to raise substantially level walls. As previously mentioned, when at least partially embedded into the mortar joints, device 10 and, more significantly, device 110 can provide substantial reinforcement to the wall and substantial strength for tying the wall to other structures through wall ties.

In addition to being placed between courses of masonry elements, the devices of the present invention can even be laid onto or into a poured foundation to provide a level base upon which to lay the first course of masonry elements. The device of the present invention is easily leveled using a straight edge across the thin, upstanding edges 20, 22 of the support members 12, 14 before the foundation sets. A first course of masonry elements 36 can then be laid simply and quickly upon the leveled device 10, 110 or 210 in the same manner as overlying courses.

While the preferred embodiment of the invention has been disclosed, it will be recognized by those skilled in the art that changes could be made to the above-described embodiment invention without departing from the broad, inventive concepts thereof. Thus, the configuration of the support members, the spacer means, the reinforcing means and/or the bridge members may all be varied in geometry and layout while still providing substantially equal performance. For example, the members may simply be planar and upstanding, the V-shaped members can be in opposite orientations (one V-apex thin edge on one side of the device and the other V-apex thin edge on the opposite side of the device. It should be understood, therefore, that this invention is not limited to the particular embodiment disclosed, but is intended to cover any modifications which are within the scope and spirit of the invention as defined by the appended claims.

We claim:

1. A planar leveling device comprising:

first and second elongated, substantially rigid support members, each support member being about one foot or more in length, the first and second support members defining the plane of the device and having uniform equal maximum heights in directions perpendicular to the plane, the device having a maximum height in directions perpendicular to the plane equal to the equal heights of the first and second support members, each of the first and second support members being at least generally pointed along at least one side to provide only a thin edge along one planar side of the device, each of the first and second support members increasing in width between the thin edge on one side of the member and a side of the member opposite the one side, each support member at least maintaining the increase in width to the opposing side of the member; and spacer means for coupling the first and second elongated members together in spaced, side-by-side relation.

2. The device of claim 1 wherein the thin edges are on-center spaced less than above five inches apart.

3. The device of claim 2 wherein the thin edges are spaced on-center at least about 2¾ inches apart.

4. The device of claim 1 wherein each of the support members is unbroken over the maximum height sufficiently to prevent mortar from passing transversely through the support member in the plane of the device.

5. The device of claim 1 being sufficiently open between the support members to permit mortar to pass through the device in a direction perpendicular to the plane and in a direction parallel to the support members in the plane.

6. The device of claim 1 being one-piece.

7. The device of claim 1 further comprising an elongated reinforcing member extending generally in the plane to one side of the first and second support members, spaced from the support members, the reinforcing member being coupled with at least one element of the device selected from the group consisting essentially of the first and second support members and the spacer means.

8. The device of claim 7 wherein the reinforcing member and the first and second support members all extend in parallel along the device.

9. The device of claim 1 wherein each of the support members is formed by a pair of separate walls intersecting at the thin edge, each of the separate walls extending from the thin edge on the one side of the support member transversely with respect to the height and width directions of the device to the opposing side of the support member and each of the separate walls thereafter extending generally away from one another and from the support member in the plane of the device.

10. The device of claim 1 wherein the first and second support members and spacer means are provided by a one-piece, integral web.

11. The device of claim 1 wherein each of the first and second support members increases in width between the thin edge on one side of the member and a side of the member opposite the one side, each support member at least maintaining the increase in width to the opposing side of the member.

12. A planar leveling device comprising:

first and second elongated, substantially rigid support members, each support member being more than about one foot in length, the first and second support members defining the plane of the device and having uniform equal maximum heights in directions perpendicular to the plane of the device, each of the first and second members increasing in width between a thin edge on one side of the member and a side of the member opposite the one side, each support member at least maintaining the increase in width to the opposing side of the member, the device having a maximum height in directions perpendicular to the plane equal to the equal heights of the first and second support members;

spacer means for coupling the first and second elongated members together in spaced, side-by-side relation; and an elongated reinforcing member extending generally in the plane of the device to one side of the first and second support members, spaced from the support members, the reinforcing member has a height in directions perpendicular to the plane less than the maximum height, the reinforcing member being coupled with at least one of the first and second support members and the spacer means.

13. The device of claim 1 wherein each of the support members is formed by a pair of separate walls intersecting at the thin edge, each of the separate walls extending from the thin edge on the one side of the support member transversely with respect to the height and width directions of the device to the opposing side of the support member and each of the separate walls thereafter extending generally away from one another and from the support member in the plane of the device.

14. The device of claim 12 wherein the thin edges are on-center spaced less than about five inches apart.

15. The device of claim 14 wherein the thin edges are spaced on-center at least about 2¾ inches apart.

16. The device of claim 12 wherein each of the support members in unbroken over the maximum height sufficiently to prevent mortar from passing transversely through the support member in the plane of the device.

17. The device of claim 12 being sufficiently open between the support members to permit mortar to pass through the device in a direction perpendicular to the plane and in a direction parallel to the support members in the plane.

18. The device of claim 12 wherein at least the first and second support members and the spacer means are formed together in one-piece.

19. The device of claim 12 wherein the reinforcing member and the first and second support members all extend in parallel along the device.

20. The wall construction of claim 21 wherein the thin edges of the device are on-center spaced less than about five inches apart.

21. A wall construction comprising:

a first substantially horizontal course of masonry elements;

a second, generally horizontal course of masonry elements overlying the first course of elements; and a generally planar leveling device between the two courses, the device comprising first and second elongated, substantially rigid support members and spacer means for coupling the first and second support members together in spaced, side-by-side relation, each support member being more than about one foot in length and spanning at least pairs of adjoining elements in each of the first and second courses, the first and second support members defining the plane of the device and having uniform equal maximum heights in directions perpendicular to the plane of the device, the device having a maximum height in directions perpendicular to the plane equal to the equal heights of the first and second support members, each of the first and second support members is pointed along at least one side to provide only a thin edge along one planar side of the device, each of the edges being parallel to the plane of the device and contacting elements of one of the first and second courses, and the device directly contacting elements of both of the first and second courses to space the courses apart a distance equal to the maximum height of the device.

22. The wall construction of claim 10 wherein each of the elements of the first course and each of the elements of the second course contacts one of a pair of opposing generally planar sides of the leveling device and wherein the leveling device spaces the first and second course of elements apart a distance equal to the maximum height of the device in directions perpendicular to the plane.

23. The wall construction of claim 20 wherein the thin edges of the device are spaced on-center at least about 2¾ inches apart.

24. The wall construction of claim 21 wherein each of the support members of the device is unbroken over the maximum height sufficiently to prevent mortar from passing transversely through the support member in the plane of the device.

25. The wall construction of claim 21 wherein the device is sufficiently open between the support members to permit mortar to pass through the device in a direction perpendicular to the plane and in a direction parallel to the support members in the plane.

26. The wall construction of claim 21 wherein the device is one-piece.

27. The wall construction of claim 21 wherein the device further includes an elongated reinforcing member extending generally in the plane to one side of the first and second support members, spaced from the support members, the reinforcing member being coupled with at least one element of the device selected from the group consisting essentially of the first and second support members and the spacer means.

28. The wall construction of claim 21 wherein each of the first and second support members of the device increases in width between the thin edge on one side of the member and a side of the member opposite the one side, each support member at least maintaining the increase in width to the opposing side of the member.

29. The wall construction of claim 28 wherein each said support member of the device is of an inverted "V" shape and is formed by a pair of substantially planar sides intersecting one another at the thin edge.

30. The wall construction of claim 28 wherein each of the first and second support members of the device is formed by a pair of separate walls intersecting at the thin edge, each of the separate walls extending from the thin edge on the one side of the support member transversely with respect to the height and width directions of the device to the opposing side of the support member and each of the separate walls thereafter extending generally away from one another and from the support member in the plane of the device.

31. The wall construction of claim 30 wherein the first and second support members and spacer means of the device are provided by a one-piece, integral web.

32. The wall construction of claim 21 wherein each of the first and second support members is at least generally pointed along at least one side to provide only a thin edge along one planar side of the device.

33. A wall construction comprising:

a first course of masonry elements;

a second course of masonry elements overlying the first course of elements;

a generally planar leveling device between the first and second courses, the device comprising first and second elongated, substantially rigid support members, spacer means for coupling the first and second support members together in spaced, side-by-side relation, and an elongated reinforcing member, each support member being more than about one foot in length and spanning at least pairs of adjoining elements in each of the first and second courses, the first and second support members defining the plane of the device and having uniform equal maximum heights in directions perpendicular to the plane of the device, the device having a maximum height in directions perpendicular to the plane equal to the equal heights of the first and second support members, the reinforcing members extending generally in the plane of the device to one side of the first and second support members; and a bonding joint extending between the first and second courses and against an outer side of one of the first and second support members, the reinforcing member being embedded in the joint.

34. The wall construction of claim 33 wherein each of the elements of the first course and each of the elements of the second course contacts one of a pair of opposing generally planar sides of the levelling device and wherein the levelling device spaces the first and second course of elements apart a distance equal to the maximum height of the device in directions perpendicular to the plane.

35. The wall construction of claim 34 wherein the reinforcing member has a height in directions perpendicular to the plane less than the maximum height of the device and wherein the reinforcing member is coupled with at least one of the first and second support members.

36. The wall construction of claim 32 wherein the thin edges of the device are on-center spaced less than above five inches apart.

37. The wall construction of claim 36 wherein the thin edges of the device are spaced on-center at least about 2¾ inches apart.

38. The wall construction of claim 3 wherein each of the support members of the device is unbroken over the maximum height sufficiently to prevent mortar from passing transversely through the support member in the plane of the device.

39. The wall construction of claim 3 wherein the device sufficiently open between the support members to permit mortar to pass through the device in a direction perpendicular to the plane and in a direction parallel to the support members in the plane.

40. The wall construction of claim 3 wherein the first and second support members and spacer means are formed in one piece.

41. The wall construction of claim 32 wherein each of the first and second support members of the device increases in width between the thin edge on one side of the member and a side of the member opposite the one side, each support member at least maintaining the increase in width to the opposing side of the member.

42. The wall construction of claim 41 wherein each said support member of the device is of an inverted "V" shape and is formed by a pair of substantially planar sides intersecting one another at the thin edge.

43. The wall construction of claim 41 wherein each of the first and second support members of the device is formed by a pair of separate walls intersecting at the thin edge, each of the separate walls extending from the thin edge on the one side of the support member transversely with respect to the height and width directions of the device to the opposing side of the support member and each of the separate walls thereafter extending generally away from one another and from the support member in the plane of the device.

44. The wall construction of claim 43 wherein the first and second support members and spacer means of the device are provided by a one-piece, integral web.

* * * * *